US006774571B2

(12) United States Patent
Choi et al.

(10) Patent No.: US 6,774,571 B2
(45) Date of Patent: Aug. 10, 2004

(54) ELECTRODELESS LIGHTING SYSTEM

(75) Inventors: Joon-Sik Choi, Seoul (KR); Yong-Seog Jeon, Gwangmyeong (KR); Hyo-Sik Jeon, Gwangmyeong (KR); Hyun-Jung Kim, Seoul (KR); Ji-Young Lee, Gwangmyeong (KR); Byeong-Ju Park, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/213,148

(22) Filed: Aug. 7, 2002

(65) Prior Publication Data

US 2003/0141828 A1 Jul. 31, 2003

(30) Foreign Application Priority Data

Jan. 25, 2002 (KR) ..... 10-2002-0004555
Jan. 25, 2002 (KR) ..... 10-2002-0004554

(51) Int. Cl.[7] ..... F21V 29/00
(52) U.S. Cl. ..... 315/112; 315/248; 362/373
(58) Field of Search ..... 315/244, 248, 315/112–118, 246; 362/373; 353/52–61

(56) References Cited

U.S. PATENT DOCUMENTS 4,645,967 A * 2/1987 Bouman et al. ..... 313/248
4,727,294 A * 2/1988 Houkes et al. ..... 315/248
5,786,667 A * 7/1998 Simpson et al. ..... 315/39
5,803,566 A * 9/1998 Ogino ..... 353/60
5,847,517 A * 12/1998 Ury et al. ..... 315/248
5,998,934 A * 12/1999 Mimasu et al. ..... 315/118
2002/0105276 A1 * 8/2002 Jeon ..... 315/5.13
2002/0140381 A1 * 10/2002 Golkowski et al. ..... 315/363
2003/0141828 A1 * 7/2003 Choi et al. ..... 315/248

* cited by examiner

*Primary Examiner*—Wilson Lee
(74) *Attorney, Agent, or Firm*—Birch, Stewart, Kolasch & Birch, LLP

(57) ABSTRACT

In an electrodeless lighting system having a cooling unit for cooling a radiator therein, the electrodeless lighting system includes a microwave generating unit for generating microwave energy; a light emitting unit connected to the microwave generating unit and emitting light by forming plasma by the microwave energy generated in the microwave generating unit; a housing having a first receiving space for receiving the microwave generating unit and sealed-combined with the light emitting unit; a heat exchanger installed at the outer surface of the microwave generating unit to absorb heat generated in the microwave generating unit; a radiator installed at the outer surface of the housing; and a heat transfer member at which one end is connected to the heat exchanger and the other end is connected to the radiator by penetrating the housing to transmit heat from the heat exchanger to the radiator.

27 Claims, 8 Drawing Sheets

ELECTRODELESS LIGHTING SYSTEM

BACKGROUND OF THE INVENTION

Field of the Invention

The present invention relates to an electrodeless lighting system, and in particular to an electrodeless lighting system having a cooling unit capable of cooling a radiating unit therein. 2. Description of the Prior Art An electrodeless lighting system generates light by forming plasma by exciting light emitting materials charged inside a bulb as a vacuum state with microwave energy.

FIG. 1 is a schematic longitudinal sectional view illustrating a construction of the conventional electrodeless lighting system.

As depicted in FIG. 1, the conventional electrodeless lighting system includes a microwave generating unit 10 installed inside a housing 50 and generating microwave energy; a power supply unit 40 applying power to the microwave generating unit 10; a waveguide 20 connected to the microwave generating unit 10 and transmitting the microwave energy generated in the microwave generating unit 10; a light emitting unit 30 forming plasma 20 and generating light by being excited by the microwave energy transmitted through the waveguide 20; and a cooling fan 60 installed at a certain side of the housing 50 and cooling the microwave generating unit 10 and the power supply unit 40.

The light emitting unit 30 includes a bulb 31 in which light emitting materials are charged, a waveguide 20, a resonator 32 covering the front of the bulb 31 to cut off microwave energy and pass light generated in the bulb 31, a reflecting mirror 33 receiving the resonator 32 and intensely reflecting light generated in the bulb 31 straight and a dielectric mirror 34 passing microwave energy and reflecting light.

In the housing 50, a cooling fan 60 is received, an air suction hole 61 is formed at the lower portion corresponding to the cooling fan 60, an air path 62 is formed at the right and left portions of the air suction hole 61, and an air outlet 63 is formed at the upper portion of the housing 50 so as to correspond to the both ends of the air path 62.

The microwave generating unit 10 and the power supply unit 40 are placed between the air path 62 and the air outlet 63 and are respectively combined to the both sides of the waveguide 20.

A non-explained reference numeral 35 is an axial portion, M1 is a bulb motor rotating the bulb 31, and M2 is a fan motor rotating the cooling fan 60.

The operation of the conventional electrodeless lighting system will be described in more detail.

According to an operation signal from a control unit (not shown), the power supply unit 40 supplies power to the microwave generating unit 10, and the microwave generating unit 10 generates microwave energy having a high frequency.

While the microwave energy generated in the microwave generating unit 10 is transmitted into the resonator 32 through the waveguide 20, the light emitting materials charged inside the bulb 31 are excited and form plasma, and accordingly light is generated. The generated light lights the surroundings by being reflected by the reflecting mirror 33 and the dielectric mirror 34 toward the front.

In the meantime, while the electrodeless lighting system operates, lots of heat occurs in the microwave generating unit 10 and the power supply unit 40, etc., in particular, in the microwave generating unit 10 such as a magnetron, part of high frequency energy generated by thermal electron is not discharged but converted into heat, and accordingly an internal temperature of the housing 50 rises.

And, heat generated in the microwave generating unit 10 and the power supply unit 40, etc. may damage the internal units of the electrodeless lighting system such as the magnetron and the power supply unit 40 or cause unstableness of the system.

Accordingly, there is a need to cool the heat generated in the microwave generating unit 10 and the power supply unit 40, etc., as depicted in FIG. 1, in the conventional electrodeless lighting system, to cool heat generated in the microwave generating unit 10, etc. outer air flows into the housing 50 by operating the cooling fan 60.

However, in the conventional electrodeless lighting system, because outer air flows into the housing 50 by operating the cooling fan 60, impurities may penetrate into the housing 50, and accordingly the internal units may be damaged. Particularly, when the electrodeless lighting system is installed at the exterior, rain drops or other impurities may penetrate into the housing 50, and accordingly various parts may be damaged.

SUMMARY OF THE INVENTION

In order to solve the above-mentioned problems, it is an object of the present invention to provide an electrodeless lighting system having a cooling unit capable of being installed in a housing and efficiently cooling a microwave generating unit sealed in the housing.

In order to achieve the above-mentioned object, an electrodeless lighting system in accordance with the present invention includes a microwave generating unit for generating microwave energy; a light emitting unit connected to the microwave generating unit and emitting light by forming plasma by the microwave energy generated in the microwave generating unit; a housing having a first receiving space for receiving the microwave generating unit and sealed-combined with the light emitting unit; a heat exchanger installed at the outer surface of the microwave generating unit to absorb heat generated in the microwave generating unit; a radiator installed at the outer surface of the housing; and a heat transfer member at which one end is connected to the heat exchanger and the other end is connected to the radiator by penetrating the housing to transmit heat from the heat exchanger to the radiator.

The system further includes a fan housing having an air inlet hole for air inflow, an air discharge hole for discharging air and an air path connected to the air inlet hole and the air discharge hole and fixedly installed at the outer surface of the housing; and a fan installed in the air path to generate air flow in the air path; wherein the radiator is installed in the air path.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Hereinafter, an electrodeless lighting system in accordance with the present invention will be described in detail with reference to accompanying FIGS. 2~7.

Figure 1:
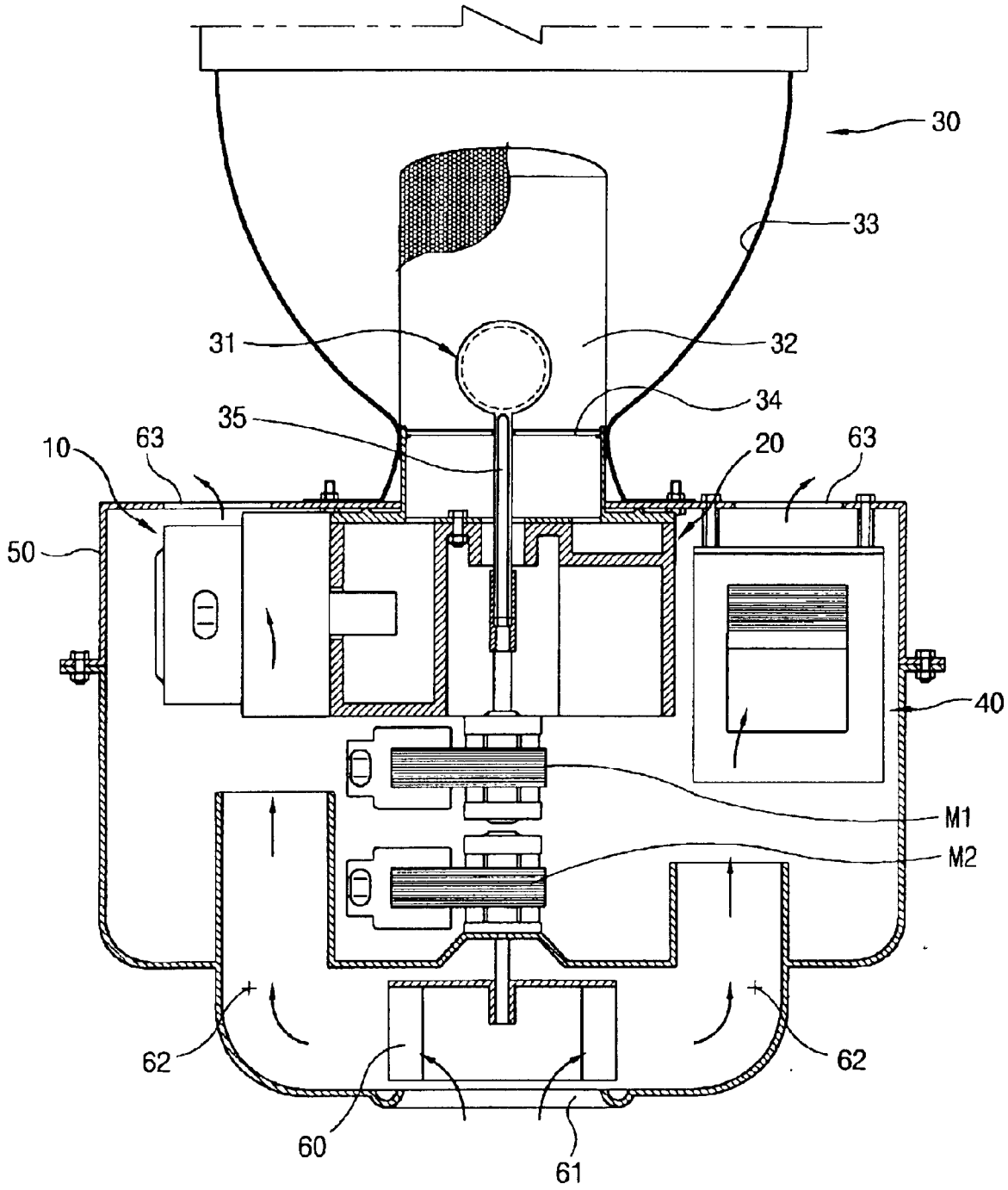
FIG.1 CONVENTIONAL ART
FIG. 1 is a longitudinal sectional view illustrating a construction of the conventional electrodeless lighting system.
Figure 2:
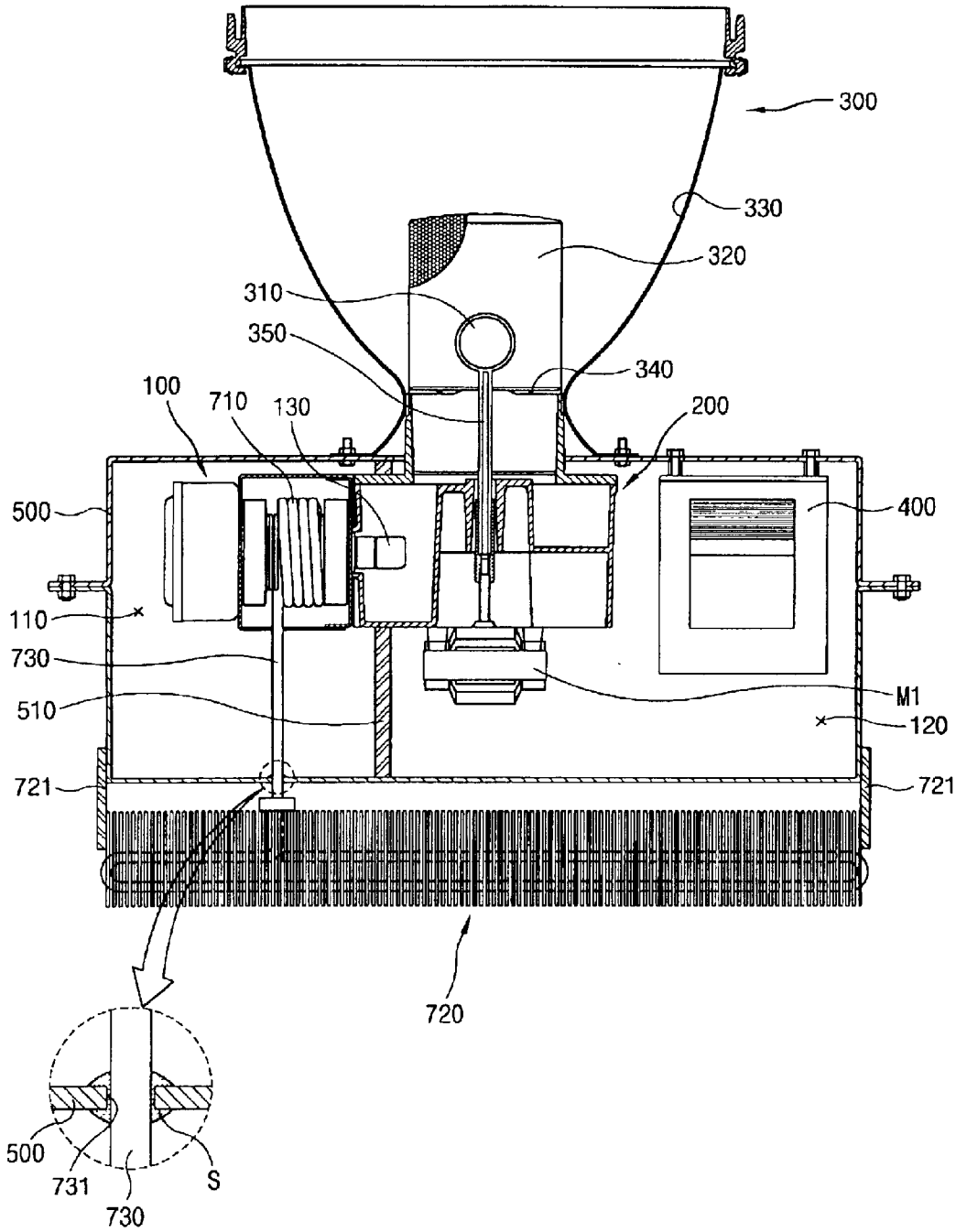
FIG. 2 is a longitudinal sectional view illustrating an electrodeless lighting system in accordance with an embodiment of the present invention.

As depicted in FIG. 2, the electrodeless lighting system in accordance with the present invention includes a magnetron 100 as a microwave generating unit for generating microwave energy; a light emitting unit 300 connected to the magnetron 100 and emitting light by forming plasma according to the microwave energy generated in the magnetron 100; a housing 500 having a magnetron receiving space 110 for receiving the magnetron 100 and sealed-combined with the light emitting unit 300; a heat exchanger 710 installed at the outer surface of the magnetron 100 to absorb heat generated in the magnetron 100; a radiator 720 installed at the outer surface of the housing 500; and a heat transfer member 730 at which one end is connected to the heat exchanger 710 and the other end is connected to the radiator 720 by penetrating the housing 500 to transmit heat from the heat exchanger 710 to the radiator 720.

The light emitting unit 300 includes a bulb 310 in which light emitting materials are charged, a waveguide 200, a resonator 320 covering the-front of the bulb 310 to cut off microwave energy and pass light generated in the bulb 310, a reflecting mirror 330 receiving the resonator 320 and intensely reflecting light generated in the bulb 310 straight and a dielectric mirror 340 passing microwave and reflecting light.

The light emitting unit 300 is connected to the magnetron 100 by the waveguide 200 transmitting microwave energy generated in the magnetron 100 to the light emitting unit 300.

Figure 3:
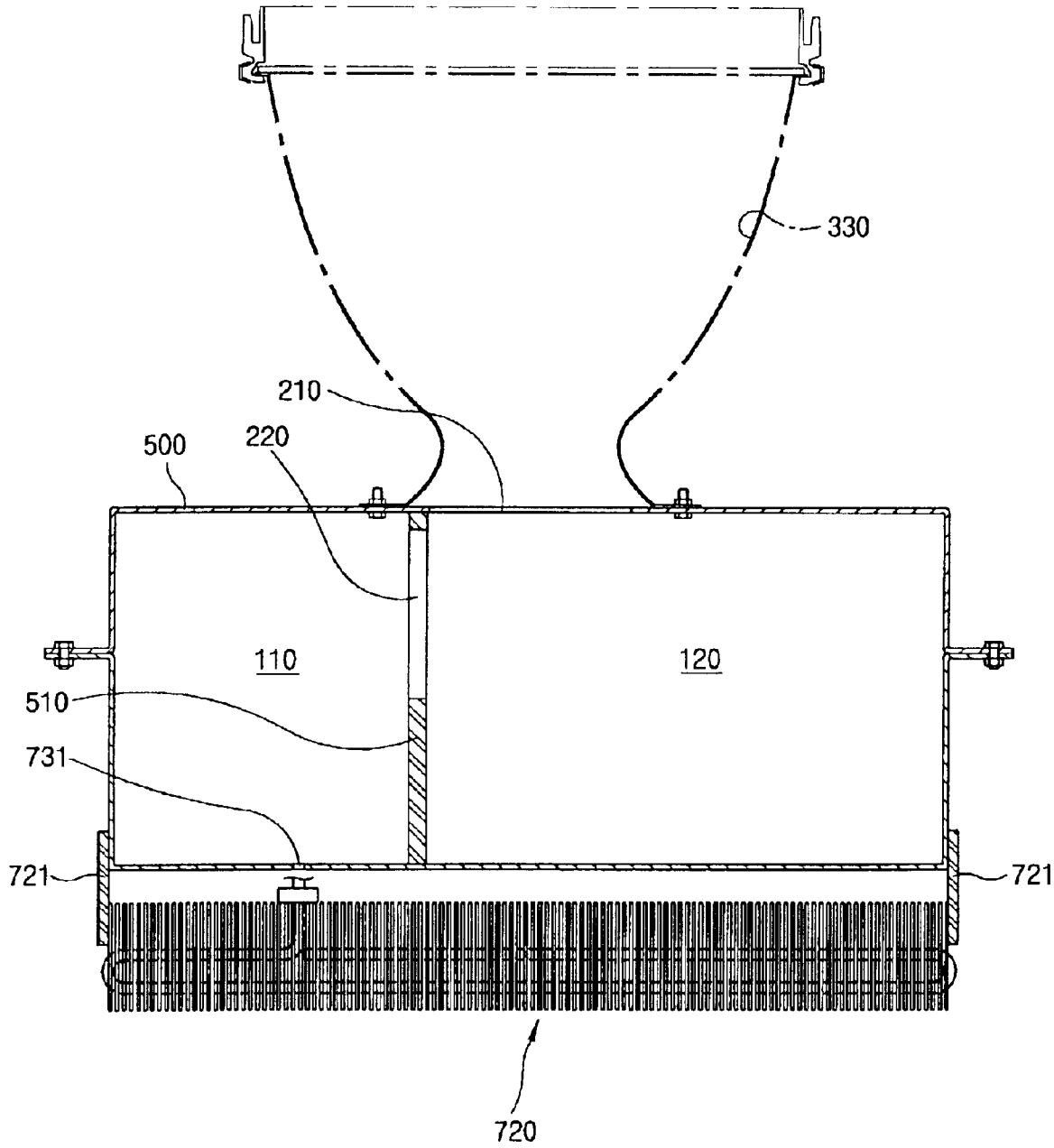
FIG. 3 is a longitudinal sectional view illustrating a housing of the electrodeless lighting system in FIG. 2.

As depicted in FIGS. 2 and 3, the housing 500 is made of a material having a high heat conductivity, an opening 210 of the waveguide 200 assembled with the light emitting unit 300 is formed at the front surface, and a hole 731 is formed at the rear surface to pass and connect the heat transfer member 730 with the radiator 720.

In the housing 500, a receiving space is formed to receive internal units such as the magnetron, etc., it is sealed by combining with the light emitting unit 300. In addition, to separately receive the magnetron 100 from other internal units, a heat insulating wall 510 is formed to divide the receiving space into a magnetron receiving space 110 and an other units receiving space 120.

In order to receive a part of the waveguide 200 with the magnetron 100 inside the magnetron receiving space 110, the heat insulating wall 510 can be fabricated as a plate member (not shown) covering the middle portion of the waveguide 200, or it can be fabricated as one body with the waveguide 200 and be combined with the housing 500.

As depicted in FIG. 2, the heat insulating wall 510 can be formed in one body with the housing 500. In addition, the heat insulating wall 510 may have a through hole 220 for an outlet 130 of the waveguide 200, and a hole (not shown) for an electric wire to apply power to the microwave generating unit.

Herein, the housing 500 and the heat insulating wall 510 can be fabricated as a simple molding method or an insert molding method according to materials thereof.

Figure 4:
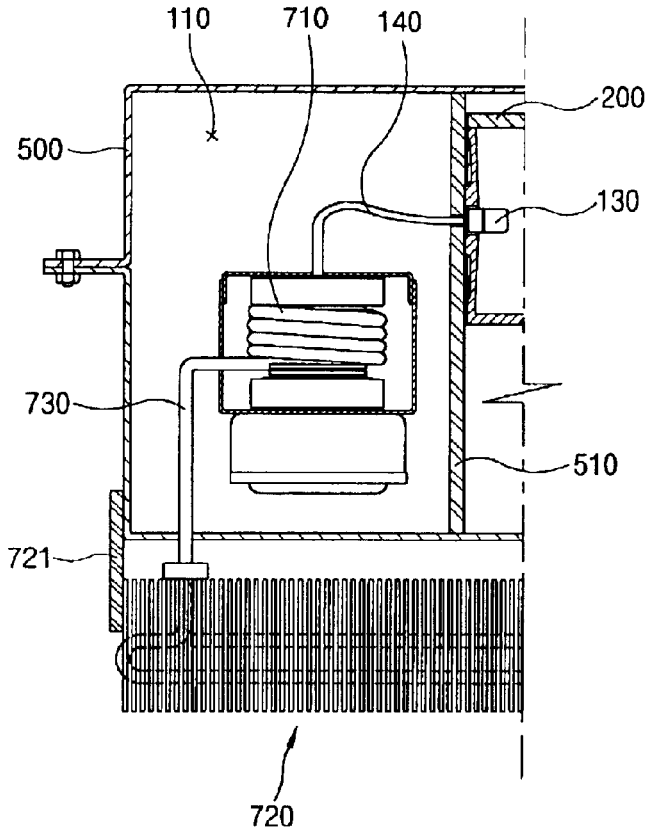
FIG. 4 is a partial longitudinal-sectional view illustrating a magnetron, which is connected to a waveguide by a coaxial cable, of the electrodeless lighting system in FIG. 3.

As depicted in FIG. 4, the heat insulating wall 510 can be placed between the waveguide 200 and the magnetron 200, in that case, assembly can be performed after fabricating the heat insulating wall 510 separately, or the heat insulating wall 510 can be fabricated at a certain side surface of the waveguide 200 as one body.

The other internal units receiving space 120 receives the power supply unit 400 and a bulb motor (M1) combined with an axial portion 350 of the bulb 310. to rotate the bulb 310.

The heat exchanger 710, the radiator 720 and the heat transfer member 730 construct one cooling system, cooling system can be variously formed such as a heat pipe and thermoelectric element, etc. according to cooling types, in case of needs, a heat exchanger and a heat transfer member can be fabricated as one body such as a heat pipe and thermoelectric element.

In the electrodeless lighting system in accordance with the present invention, as a heat pipe consisting of the heat exchanger 710 and the heat transfer member 730 as one body, the heat exchanger 710 has a cylindrical or rectangular, etc. shaped section, the end of the heat exchanger 710 is wound around and combined with the outer circumference of an anode cylinder (not shown) as a light emitting portion of the magnetron 100 by a welding or a thermal bond in order to make an internal working fluid convert its phase according to a temperature of the anode cylinder.

Herein, it is preferable to add a heat transfer material such as grease or paste, etc. at contact surfaces of the heat exchanger 710 and the magnetron 100 in order to improve a light emitting efficiency of the magnetron 100.

The heat transfer member 730 constructed as one body with the heat exchanger 710 passes the hole 731 formed at the housing 500 and is combined with the radiator 720 by a welding or a thermal bond. Herein, as depicted in FIG. 2, it is preferable to fill up a space between the hole 731 and the heat transfer member 730 with sealing member (S) such as silicon, etc., or seal-combine them by a welding in order to prevent penetration of rain drops or impurities.

The heat transfer member 730 can connect the heat exchanger 710 and the radiator 720 by using a block type member made of aluminum or copper having a good heat conductivity besides the heat pipe. The heat transfer member 730 can have various section shapes such as a circular or a rectangular shape.

As depicted in FIG. 2, the radiator 720 consists of plural cooling pins fabricated as a thin plate shape having a good heat conductivity and combined with the heat transfer member 730. Herein, the plural cooling pins are fixedly combined with the housing 500 by a connecting bracket 721 with a certain distance from the outer surface of the housing 500, or a plate-shaped cooling plate (not shown) having a certain thickness and width made with a material having a good heat conductivity can be fabricated and fixedly combined with the housing 500 by the connecting bracket 721.

The connecting bracket 721 for combining the radiator 720 with the housing 500 uses a heat insulating member in order not to transmit heat to the housing 500.

Figure 5:
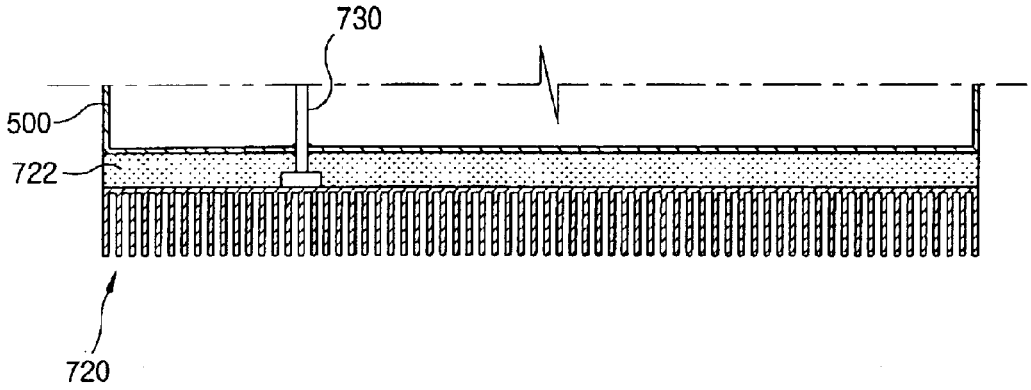
FIG. 5 is a partial transverse-sectional view illustrating a radiator, which is installed to a housing after interposing a heat insulating member between them, of the electrodeless lighting system in FIG. 3.

In the meantime, as depicted in FIG. 5, on behalf of the connecting bracket 721, a heat insulating member 722 can be inserted between the housing 500 and the radiator 720 and be combined with the housing 500.

In the waveguide 200 fabricated as a ring shape at which a hollow portion is formed at its central portion, an inlet 242 is formed so as to connect to the outlet of the magnetron 100, a bulb side hole 243 is formed at the upper portion so as to pass through an axial portion 350 of the bulb 310, and a ring-shaped outlet 244 is formed at the circumference of the bulb side hole 243 so as to connect with the resonator 320.

Figure 6:
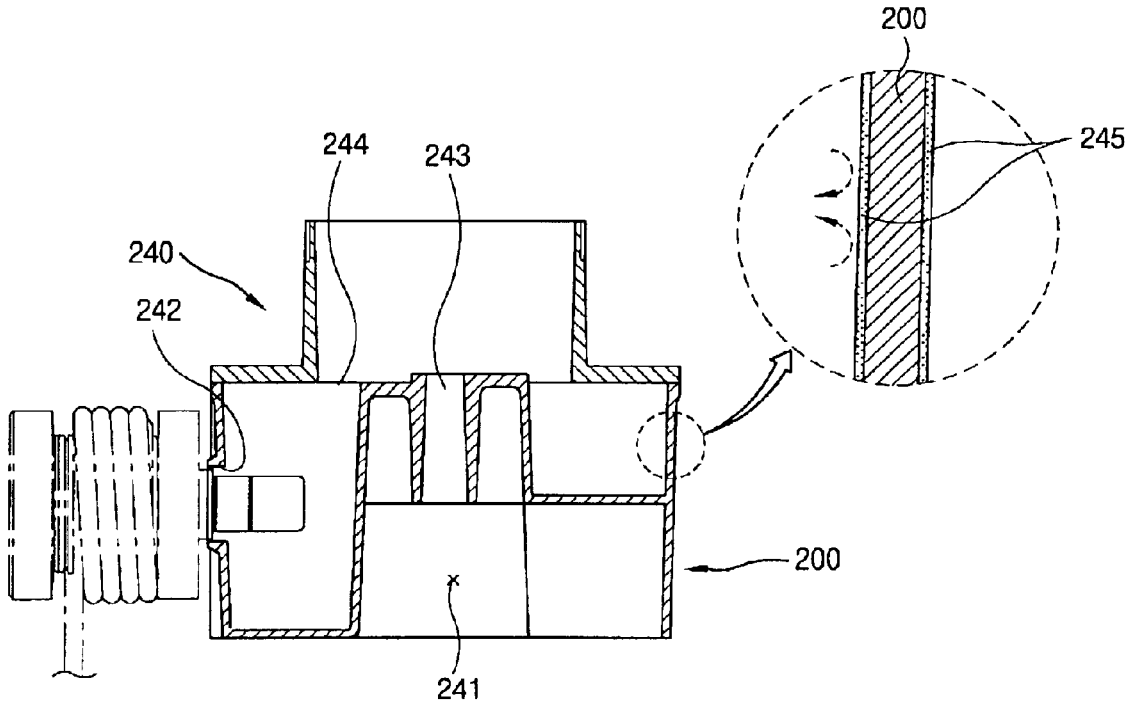
FIG. 6 is a partial longitudinal-sectional view illustrating a construction of a waveguide of the electrodeless lighting system in FIG. 3.

As depicted in FIG. 6, it is preferable to form a heat insulating layer 245 at the inner and outer surfaces of the waveguide 200 to prevent heat generated in lighting of the bulb 310 from back-flowing through the outlet 244 of the waveguide 200 and radiating inside the housing 500 through each wall surface.

The outlet 130 of the magnetron 100 can be directly connected to the inlet 242 of the waveguide 200. In case of needs, as depicted in FIG. 4, the outlet 130 of the magnetron 100 can be connected to the inlet 242 of the waveguide 200 by using an additional coaxial cable 140. In that case, because a position of the magnetron 100 can be freely changed, designing of the heat insulating wall 510 can be facilitated.

Figure 7:
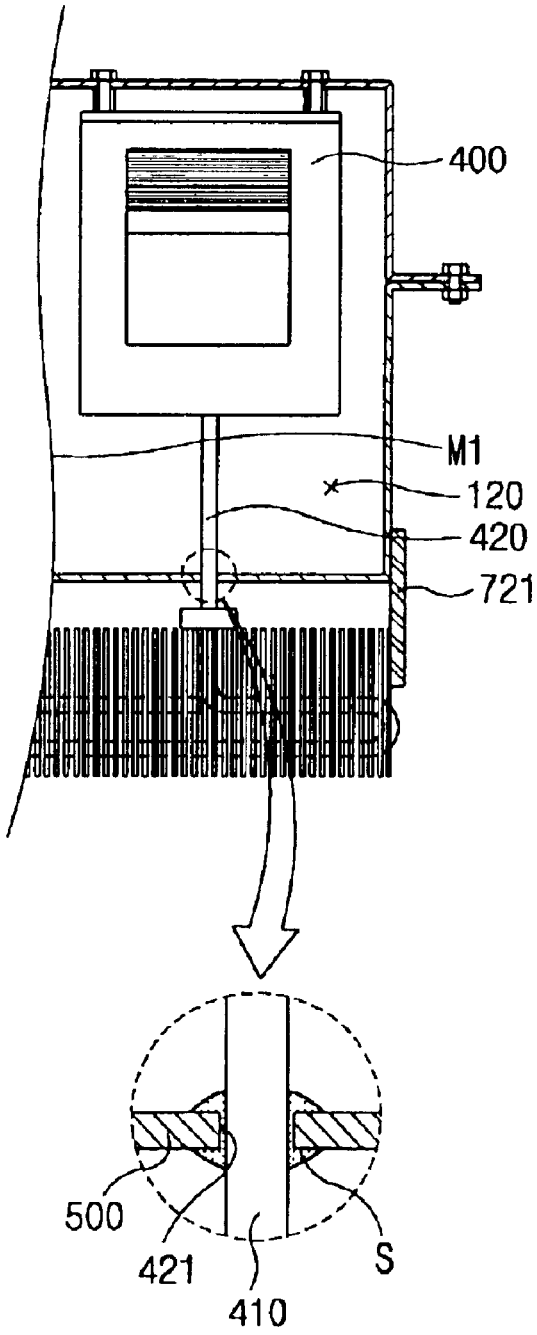
FIG. 7 is a partial longitudinal-sectional view illustrating a power supply unit, at which a heat transfer member is connected, of the electrodeless lighting system in FIG. 3.

In the meantime, as depicted in FIG. 2 or 7, the power supply unit 400 for applying power to the internal units such as the magnetron 400, etc. can be installed inside the housing 500.

Particularly, as depicted in FIG. 2 or 7, in the power supply unit 400, in order to radiate heat generated in the power supply unit 400, a heat exchanger (not shown) and the heat transfer member 420 are installed at the outer surface of the power supply unit 400. A heat pipe or a heat transfer rod made of copper or aluminum can be used as the heat transfer member 420. The heat transfer member 420 passes through the housing 500 and connects the power supply unit 400 with the radiator 720, and accordingly heat can be radiated outside of the housing 500.

In the meantime, in the electrodeless lighting system in accordance with the present invention, in order to make the radiator 720 radiate heat more efficiently, a fan assembly for generating air flow around the radiator 720 can be additionally installed.

Figure 8:
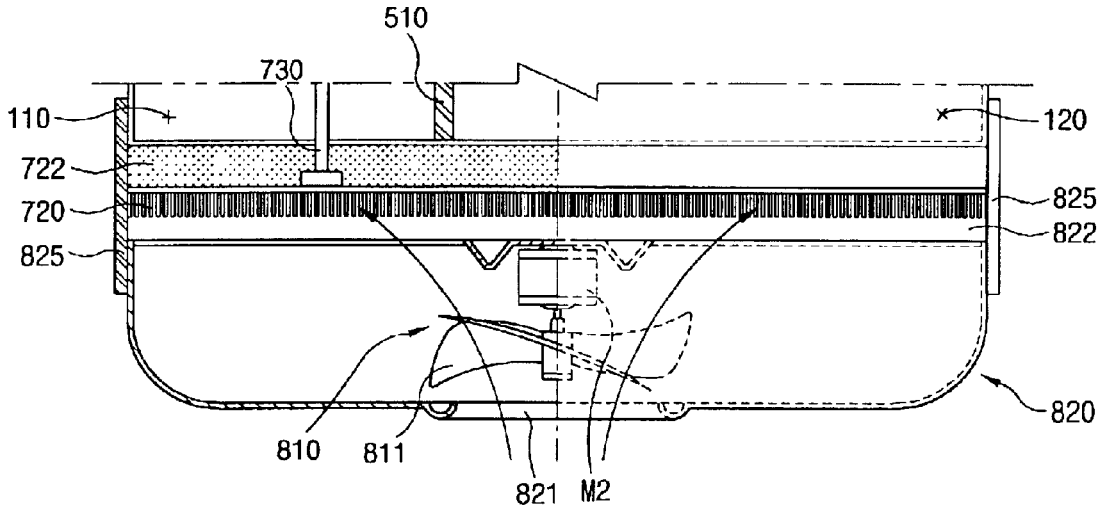
FIG. 8 is a partial expanded view illustrating a fan assembly additionally installed at the electrodeless lighting system in FIG. 2.
Figure 9:
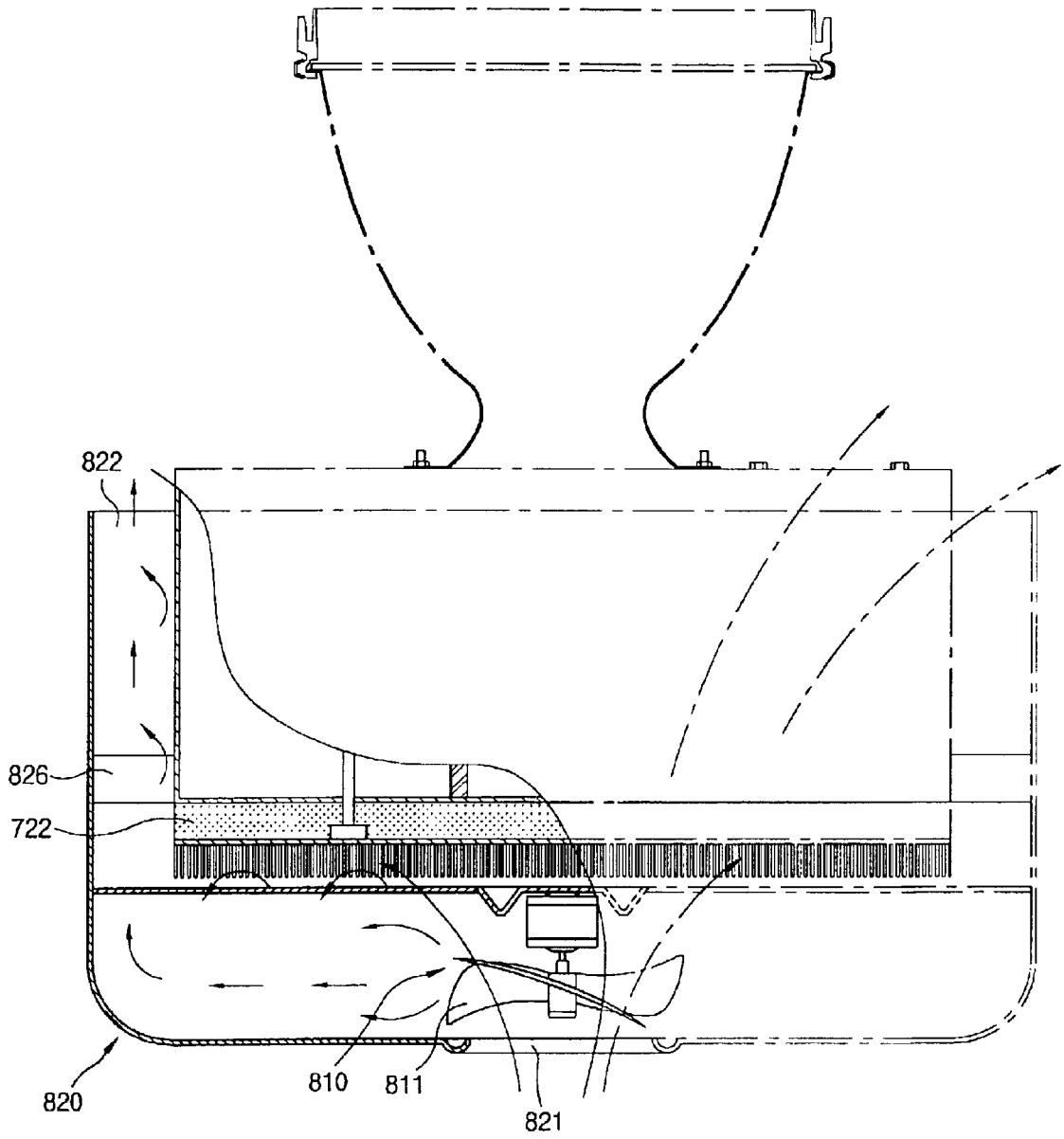
FIG. 9 is a partial expanded view illustrating another fan assembly additionally installed at the electrodeless lighting system in FIG. 2.

FIG. 8 is a partial expanded view illustrating a fan assembly additionally installed at the electrodeless lighting system in FIG. 2, and FIG. 9 is a partial expanded view illustrating another fan assembly additionally installed at the electrodeless lighting system in FIG. 2.

As depicted in FIG. 8, the fan assembly includes an air inlet hole 821 for air inflow; an air discharge hole 822 for discharging air; a fan housing 820 having an air path (not shown) connecting the air inlet hole 821 and the air discharge hole 822; and a fan 810 installed inside the air path to generate air flow.

The fan housing 820 is fixedly combined with the housing 500 by a connecting member 825, etc. Herein, the radiator 720 is placed in the air path. The radiator 720 can be fabricated as FIG. 2 or 5. In FIG. 8, the radiator 720 in FIG. 5 is used.

In addition, as depicted in FIG. 9, the fan housing 820 can be fixedly installed at the housing 500 by a fixing member 826 so as to make the air path cover part of the housing 500.

In the fan housing 820, the fan 810 and a fan motor (M2) for rotating the fan 810 are installed, as depicted in FIGS. 8 and 9, the fan 810 can use an axial fan to facilitate a channel design of the fan housing 820 or a centrifugal fan to reduce a noise even it has a relatively complicated channel shape.

The operation and advantages of the electrodeless lighting system in accordance with the present invention will be described in more detail.

According to an operation signal of the control unit (not shown), the power supply unit 400 operates the magnetron 100, and the magnetron 100 generates microwave energy.

The microwave energy generated in the magnetron 100 is transmitted to the resonator 300 through the waveguide 200 and excites materials enclosed in the bulb 310 to form plasma, light is generated by the plasma, and accordingly the light illuminates a space while being reflected toward the front by the reflecting mirror 330 and the dielectric mirror 340.

Herein, lots of heat occurs in the magnetron 100, the heat is discharged while being transmitted to the radiator 720 installed at the outer surface of the housing 500 through the heat pipe or the heat exchanger 710 and the heat transfer member 730 made of aluminum or copper, and accordingly the magnetron 100 is cooled.

In addition, in the power supply unit 400, high heat occurs in boosting and supplying power to the magnetron 100, the heat is transmitted to the radiator 720 through the heat exchanger (not shown) and the heat transfer member 420 installed at the outer surface of the power supply unit 400 and connected to the radiator 720 and is discharged.

In addition, in the bulb 310, besides visible rays infrared rays occur, the infrared rays are radiated by convection while being rotated by the bulb motor (M1), however, part of the infrared rays may back-flow into the waveguide 200 and radiate into the housing 500, in order to prevent it, the heat insulating layer 245 is formed at the inner and outer surfaces of the waveguide 200, and accordingly it is possible to prevent efficiently the heat of the bulb 310 from transmitting to the housing 500.

In addition, by dividing the internal space of the housing 500 into the magnetron receiving space 110 and other internal units receiving part 120 by the heat insulating wall 510, it is possible to prevent high heat generated in the magnetron 100 from transmitting to other internal units.

In addition, because the heat insulating wall 510 is made of heat insulating materials, it is possible to prevent relatively high heat generated in the magnetron 100 from transmitting to other internal units, and accordingly overheat of the power supply unit 400 or the bulb motor (M1) can be prevented.

In addition, by fixedly combining the radiator 720 with the housing 500 by using the connecting bracket 721 made of heat insulating materials with a distance from the outer surface of the housing 500 or by interposing the heat insulating member 722 between the housing 500 and the radiator 720 and tightly combining them, it is possible to prevent heat generated in the magnetron 100 or the power supply unit 400 and transmitted to the radiator 720 from back-flowing into the housing 500, and accordingly error-operation or damage of the internal parts of the housing 500 due to heat can be prevented.

In particular, in the conventional electrodeless lighting system, when it is placed at the exterior, internal units of a housing may be damaged due to penetration of rain drops or impurities. However, in the electrodeless lighting system in accordance with the present invention, by separately receiving a magnetron by dividing internal space of the housing, winding a heat transfer member such as a heat pipe around the outer circumference of the magnetron and connecting the end of the heat transfer member to a cooling pins substrate or a cooling plate placed at the outside of the housing, heat generated in the magnetron can be efficiently radiated. In addition, by sealing the housing, penetration of rain drops or impurities into the housing can be efficiently prevented.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An electrodeless lighting system, comprising:

a microwave generating unit for generating microwave energy;

a light emitting unit connected to the microwave generating unit and emitting light by forming plasma by the microwave energy generated in the microwave generating unit;

a housing having a first receiving space for receiving the microwave generating unit and sealed-combined with the light emitting unit;

a heat exchanger installed in the housing at the outer surface of the microwave generating unit to absorb heat generated in the microwave generating unit;

a radiator installed at the outer surface of the housing; and a heat transfer member at which one end is connected to the heat exchanger and the other end is connected to the radiator by penetrating the housing to transmit heat from the heat exchanger to the radiator.

2. The system of claim 1, further comprising:

a waveguide received in a second receiving space of the housing and transmitting microwave energy from the microwave generating unit to the light emitting unit.

3. The system of claim 2, wherein a heat insulating wall is formed at the internal or the outer surface of the waveguide.

4. The system of claim 2, wherein a heat insulating wall is formed at the internal and the outer surfaces of the waveguide.

5. The system of claim 1, wherein the light emitting unit includes:

a resonator cutting off microwave energy and passing light; and a bulb filled with materials forming plasma by microwave energy.

6. The system of claim 1, wherein the heat exchanger and the heat transfer member are formed as one body.

7. The system of claim 1, wherein the microwave generating unit is a magnetron.

8. An electrodeless lighting system comprising:

a microwave generating unit for generating microwave energy, wherein the microwave generating unit is a magnetron;

a light emitting unit connected to the microwave generating unit and emitting light by forming plasma by the microwave energy generated in the microwave generating unit;

a housing having a first receiving space for receiving the microwave generating unit and sealed-combined with the light emitting unit;

a heat exchanger installed at the outer surface of the microwave generating unit to absorb heat generated in the microwave generating unit, wherein the heat exchanger is a coil wound around the outer surface of an anode body of the magnetron;

a radiator installed at the outer surface of the housing; and a heat transfer member at which one end is connected to the heat exchanger and the other end is connected to the radiator by penetrating the housing to transmit heat from the heat exchanger to the radiator.

9. An electrodeless lighting system comprising:

a microwave generating unit for generating microwave energy;

a light emitting unit connected to the microwave generating unit and emitting light by forming plasma by the microwave energy generated in the microwave generating unit;

a housing having a first receiving space for receiving the microwave generating unit and sealed-combined with the light emitting unit;

a heat exchanger installed at the outer surface of the microwave generating unit to absorb heat generated in the microwave generating unit;

a radiator installed at the outer surface of the housing; and a heat transfer member at which one end is connected to the heat exchanger and the other end is connected to the radiator by penetrating the housing to transmit heat from the heat exchanger to the radiator, wherein the heat transfer member is a heat pipe.

10. The system of claim 1, wherein the heat transfer member is a thermoelectric device.

11. The system of claim 1, wherein the first receiving space has a heat insulating wall to insulate other units inside the housing from heat generated in the microwave generating unit.

12. The system of claim 11, wherein the first receiving space is sealed by the heat insulating wall, the heat insulating wall has an opening formed for connecting an output of the microwave generating unit to the light emitting unit and a hole formed for an electric wire to apply power to the microwave generating unit.

13. The system of claim 11, wherein the heat insulating wall is formed as one body with the housing.

14. The system of claim 11, wherein the heat insulating wall is received in the housing and formed as one body with the waveguide transmitting microwave energy from the microwave generating unit to the light emitting unit.

15. The system of claim 1, wherein the radiator is fixedly installed at the outer surface of the housing by a fixing member so as to have a certain distance from the housing.

16. An electrodeless lighting system comprising:

a microwave generating unit for generating microwave energy;

a light emitting unit connected to the microwave generating unit and emitting light by forming plasma by the microwave energy generated in the microwave generating unit;

a housing having a first receiving space for receiving the microwave generating unit and sealed-combined with the light emitting unit;

a heat exchanger installed at the outer surface of the microwave generating unit to absorb heat generated in the microwave generating unit;

a radiator installed at the outer surface of the housing; and a heat transfer member at which one end is connected to the heat exchanger and the other end is connected to the radiator by penetrating the housing to transmit heat from the heat exchanger to the radiator, wherein the radiator is fixedly installed at the outer surface of the housing by a fixing member so as to have a certain distance from the housing, and wherein the fixing member has a heat insulating characteristic.

17. The system of claim 1, wherein a heat insulating member is interposed between the radiator and the outer surface of the housing, and the radiator is fixedly installed at the outer surface of the housing.

18. The system of claim 1, wherein the radiator consists of plural radiating pins combined with the heat transfer member.

19. The system of claim 1, wherein the section of the heat transfer member has a quadrilateral shape.

20. An electrodeless lighting system comprising:

a microwave generating unit for generating microwave energy;

a light emitting unit connected to the microwave generating unit and emitting light by forming plasma by the microwave energy generated in the microwave generating unit;

a housing having a first receiving space for receiving the microwave generating unit and sealed-combined with the light emitting unit;

a heat exchanger installed at the outer surface of the microwave generating unit to absorb heat generated in the microwave generating unit;

a radiator installed at the outer surface of the housing;

a heat transfer member at which one end is connected to the heat exchanger and the other end is connected to the radiator by penetrating the housing to transmit heat from the heat exchanger to the radiator;

a fan housing having an air inlet hole for air inflow, an air discharge hole for discharging air and an air path connected to the air inlet hole and the air discharge hole and fixedly installed at the outer surface of the housing; and a fan installed in the air path to generate air flow in the air path;

wherein the radiator is installed in the air path.

21. The system of claim 20, wherein the fan housing is combined with the housing by a connecting means with a distance from the housing.

22. The system of claim 20, wherein the air path is formed so as to surround the outer surface of the housing.

23. The system of claim 1, further comprising:

a power supply unit received in a third receiving space formed inside the housing to apply power to the microwave generating unit.

24. An electrodeless lighting system comprising:

a microwave generating unit for generating microwave energy,;

a light emitting unit connected to the microwave generating unit and emitting light by forming plasma by the microwave energy generated in the microwave generating unit;

a housing having a first receiving space for receiving the microwave generating unit and sealed-combined with the light emitting unit;

a heat exchanger installed at the outer surface of the microwave generating unit to absorb heat generated in the microwave generating unit;

a radiator installed at the outer surface of the housing;

a heat transfer member at which one end is connected to the heat exchanger and the other end is connected to the radiator by penetrating the housing to transmit heat from the heat exchanger to the radiator;

a power supply unit received in a third receiving space formed inside the housing to apply power to the microwave generating unit;

a heat exchanger installed at the outer surface of the power unit to absorb heat generated in the power unit; and a heat transfer member at which one end is connected to the heat exchanger and the other end is connected to the radiator by penetrating the housing to transmit heat from the heat exchanger to the radiator.

25. An electrodeless lighting system comprising:

a microwave generating unit for generating microwave energy;

a light emitting unit connected to the microwave generating unit and emitting light by forming plasma by the microwave energy generated in the microwave generating unit;

a housing having a first receiving space for receiving the microwave generating unit and sealed-combined with the light emitting unit;

a heat exchanger installed at the outer surface of the microwave generating unit to absorb heat generated in the microwave generating unit;

a radiator installed at the outer surface of the housing;

a heat transfer member at which one end is connected to the heat exchanger and the other end is connected to the radiator by penetrating the housing to transmit heat from the heat exchanger to the radiator;

a power supply unit received in a third receiving space formed inside the housing to apply power to the microwave generating unit;

a fan housing having an air inlet hole for air inflow, an air discharge hole for discharging air and an air path connected to the air inlet hole and the air discharge hole and fixedly installed at the outer surface of the housing; and a fan installed in the air path to generate air flow in the air path;

wherein the radiator is installed in the air path.

26. The system of claim 25, wherein the fan housing is combined with the housing by a connecting means with a distance from the housing.

27. The system of claim 25, wherein the air path is formed so as to surround the outer surface of the housing.

* * * * *